US010274858B2

(12) United States Patent
Fukuhara

(10) Patent No.: US 10,274,858 B2
(45) Date of Patent: Apr. 30, 2019

(54) IMAGE FORMING APPARATUS

(71) Applicant: CANON KABUSHIKI KAISHA, Tokyo (JP)

(72) Inventor: Hiroyuki Fukuhara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/725,006

(22) Filed: Oct. 4, 2017

(65) Prior Publication Data

US 2018/0113396 A1 Apr. 26, 2018

(30) Foreign Application Priority Data

Oct. 21, 2016 (JP) ..... 2017-206462
Aug. 3, 2017 (JP) ..... 2017-150540

(51) Int. Cl.
*G03G 15/00* (2006.01)
*G03G 15/04* (2006.01)
*G03G 21/16* (2006.01)

(52) U.S. Cl.
CPC ... *G03G 15/04036* (2013.01); *G03G 21/1633* (2013.01); *G03G 21/1666* (2013.01)

(58) Field of Classification Search
CPC ..... G03G 21/1666; G03G 15/04036; G03G 15/0435; G03G 15/04045
See application file for complete search history.

(56) References Cited

U.S. PATENT DOCUMENTS 9,128,291 B2 9/2015 Nagatoshi et al. .. G03G 15/043
9,523,851 B2 12/2016 Nakamura et al. .. G02B 26/121
9,581,929 B2 2/2017 Nagatoshi et al. ..... G03G 21/1666
9,658,562 B2 5/2017 Watanabe et al. ... G03G 15/556
2004/0183884 A1* 9/2004 Haginoya ..... G03G 15/04 347/129
2005/0221907 A1* 10/2005 Kato ..... G02B 26/125 473/257
2012/0251158 A1* 10/2012 Ishidate ..... G02B 26/121 399/98
2016/0363883 A1 12/2016 Fukuhara ..... G03G 15/043

FOREIGN PATENT DOCUMENTS

JP H07-68836 3/1995
JP H11-119138 4/1999
JP 2016-057506 4/2016

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes a scanner unit configured to emit light depending on image information, the scanner unit including an optical element and an optical box provided with an opening and configured to accommodate the optical element; and an outer cover of the image forming apparatus. The optical box has an open portion uncovering the optical element. The open portion of the optical box faces the outer cover.

9 Claims, 8 Drawing Sheets

IMAGE FORMING APPARATUS

FIELD OF THE INVENTION AND RELATED ART

The present invention relates to an image forming apparatus such as a printer, a copying machine or a facsimile machine.

In an optical scanning apparatus used in the image forming apparatus, such as a laser beam printer, of an electrophotographic recording type, a laser beam flux emitted from a light source depending on an image signal is deflected by a light deflector such as a polygonal mirror, and a surface of a photosensitive member is scanned with the laser beam flux. In recent year, high-speed printing with a low cost has been required, so that in order to meet this requirement, there is a need to rotate the polygonal mirror at a high speed. When the polygonal mirror is rotated at a high speed, dust (dirt) or the like deposits on a mirror surface of the polygonal mirror, so that reflectance of the polygonal mirror lowers, with the result that a light quantity on the photosensitive member lowers and thus an image density decreases. Further, when the dust or the like enters an inside of the optical scanning apparatus, the dust blocks the laser beam flux, so that an image lacks only at a portion where the dust blocks the laser beam flux in some cases.

Japanese Laid-Open Patent Application (JP-A) Hei 7-68836 discloses that communication of air between an inside and an outside of an optical box is suppressed to a low level by causing a rib provided to the optical box and a rib provided to a cover member covering an opening of the optical box to overlap with each other so as to be close to each other.

In JP-A Hei 7-68836, in order to cover the opening of the optical box, an exclusive cover member is needed. However, in order to reduce a cost of the optical scanning apparatus, a further improvement is required.

SUMMARY OF THE INVENTION

The present invention has been accomplished in view of the above-described problem.

A principal object of the present invention is to provide an image forming apparatus in which a cost is suppressed.

Another object of the present invention is to provide an image forming apparatus in which noise due to vibration of a light deflector is suppressed while maintaining a dust-proof performance at an inside of an optical box.

According to an aspect of the present invention, there is provided an image forming apparatus comprising: a scanner unit configured to emit light depending on image information, the scanner unit including an optical element and an optical box accommodating the optical element; and an outer cover of the image forming apparatus, wherein the optical box has an open portion uncovering the optical element, and wherein the open portion of the optical box faces the outer cover.

According to another aspect of the present invention, there is provided an image forming apparatus comprising: a scanner unit configured to emit light depending on image information, the scanner unit including an optical element and an optical box having an open portion and accommodating the optical element; and an outer cover of the image forming apparatus, wherein the open portion of the optical box is covered with the outer cover.

Further features of the present invention will become apparent from the following description of exemplary embodiments with reference to the attached drawings.

DESCRIPTION OF THE EMBODIMENTS

Embodiment of an image forming apparatus according to the present invention will be described with reference to the drawings. Incidentally, dimensions, materials, shapes, relative arrangement and the like of constituent elements described in the following embodiments are not intended such that the scope of the present invention is limited only thereto unless otherwise specified.

Embodiment 1

<Image Forming Apparatus>

Figure 1:
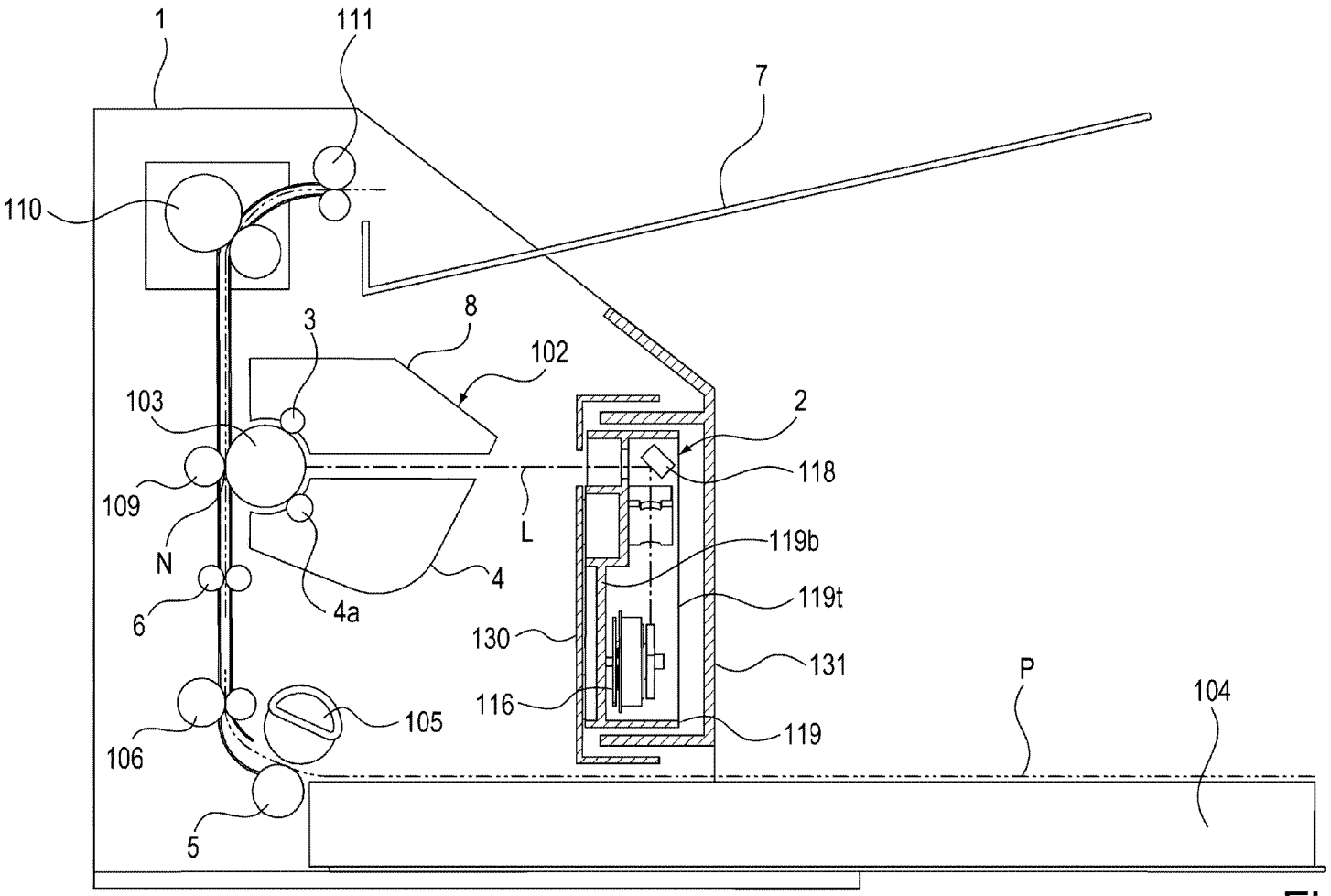
FIG. 1 is a sectional view showing a structure of an image forming apparatus according to Embodiment 1 of the present invention.

First, a structure of an image forming apparatus according to the present invention will be described with reference to FIG. 1. FIG. 1 is a sectional view showing the structure of the image forming apparatus according to the present invention. An image forming apparatus 1 shown in FIG. 1 is an example of a laser beam printer for forming an image on a recording material P such as a sheet. The image forming apparatus 1 includes a process cartridge 102 which is an image forming means, and an optical scanning apparatus 2 for irradiating a surface of a photosensitive drum 103, as an image bearing member incorporated in the process cartridge 102, with a laser beam flux L depending on image information.

The surface of the photosensitive drum 103 is electrically charged uniformly by a charging roller 3. Thereafter, the uniformly charged surface of the photosensitive drum 103 is subjected to scanning-exposure to the laser beam flux L depending on the image information by the optical scanning apparatus 2. As a result, an electrostatic latent image depending on the image information is formed on the surface of the photosensitive drum 103.

Thereafter, a developer is supplied to the electrostatic latent image, formed on the surface of the photosensitive drum 103, by a developing roller 4*a* which is a developer carrying member provided to a developing device 4 which is a developing means, so that the electrostatic latent image is developed into a toner image.

On the other hand, the recording material P accommodated in a feeding cassette 104 is separated and fed one by one by cooperation between a feeding roller 105 and a separation roller 5. Then, the recording material P is nipped and conveyed by a conveying roller pair 106 and is abutted at a free end portion thereof against a nip of a registration roller pair 6 which is at rest, so that oblique movement of the recording material P is corrected along the nip of the registration roller pair 6 by stiffness of the recording material P.

Thereafter, the registration roller pair 6 rotates at predetermined timing in synchronism with movement of the toner image formed on the surface of the photosensitive drum 103, so that the recording material P is fed to a transfer nip N formed by the surface of the photosensitive drum 103 and a surface of a transfer roller 109 which is a transfer means.

A transfer bias is applied to the transfer roller 109 by an unshown transfer bias voltage source, so that the toner image formed on the surface of the photosensitive drum 103 is transferred onto the recording material P. Residual toner remaining on the surface of the photosensitive drum 103 is removed and collected by a cleaner 8 which is a cleaning means.

The recording material P on which the toner image is sandwiched by the photosensitive drum 103 and the transfer roller 109 and is fed to a fixing device 110 which is a fixing means. Then, in a process in which the recording material P is nipped and fed by a fixing roller and a pressing roller which are provided in the fixing device 110, the toner image is heat-melted by being heated and pressed, so that the toner image is thermally fixed on the recording material P. Thereafter, the recording material P is nipped and fed by a discharging roller pair 111 and is discharged onto a discharge tray 7 provided outside of the image forming apparatus 1.

A process cartridge 102 is prepared by integrally assembling the photosensitive drum 103 and image forming process means, actable on the photosensitive drum 103, including the charging roller 103, the developing device 4, the cleaner 8 and the like. The process cartridge 102 is detachably mountable to a main assembly of the image forming apparatus 1.

<Optical Scanning Apparatus>

Figure 2:
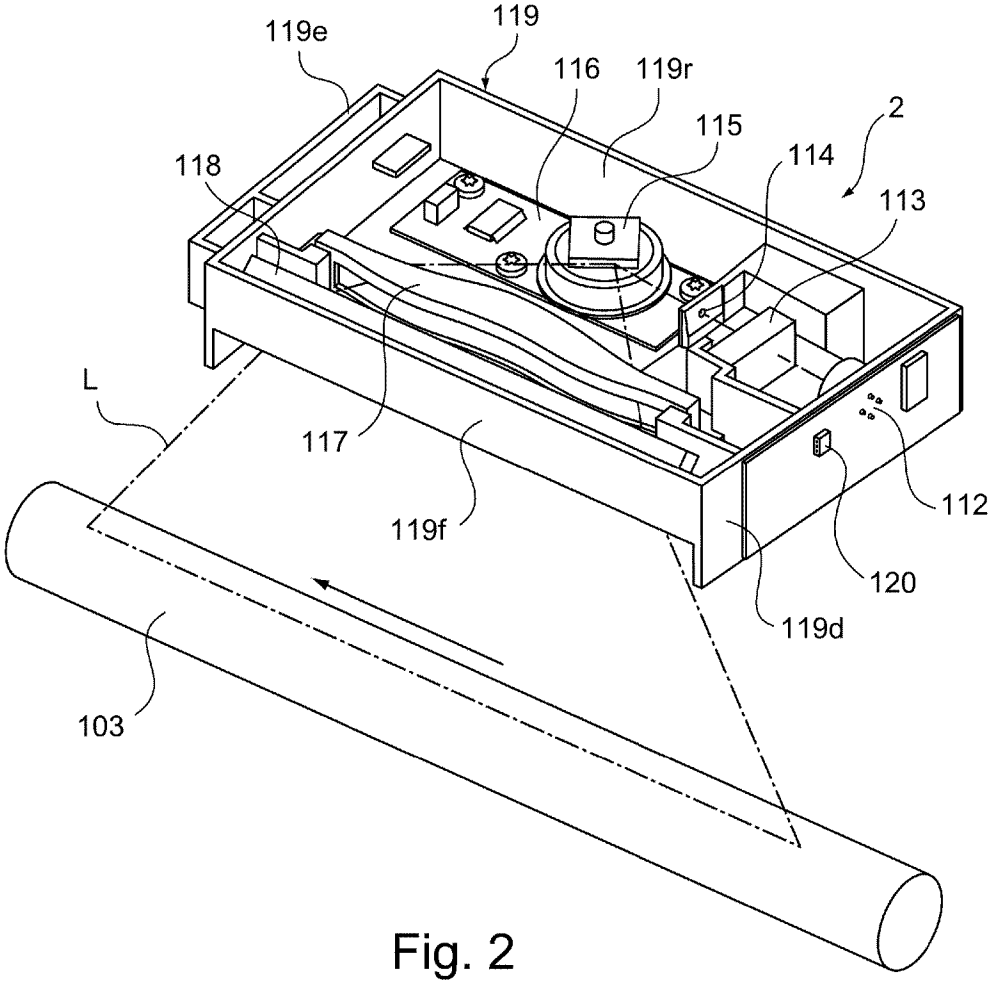
FIG. 2 is a perspective view showing a structure of an optical scanning apparatus in Embodiment 1.

Next, a structure of an optical scanning apparatus 2 will be described with reference to FIG. 2. FIG. 2 is a schematic view showing the structure of the optical scanning apparatus 2. In FIG. 2, the optical scanning apparatus 2 includes a semiconductor layer 112 which is a light source for emitting a laser beam flux L, an anamorphic collimator lens 113 prepared by integrally molding a collimator lens and a cylindrical lens, and an aperture stop 114.

The optical scanning apparatus 2 further includes a rotatable polygonal mirror 115 and a light deflector 116 for rotationally driving the rotatable polygonal mirror 115. The light deflector 116 deflects the laser beam flux L emitted from the semiconductor laser (light source) 112, so that the surface of the photosensitive drum 103 is scanned with the laser beam flux L. In the optical scanning apparatus 2, an fθ lens 117 which is a scanning lens is provided. The fθ lens 117 has a lens characteristic fθ characteristic) such that when the laser beam flux L enters the fθ lens 117 at an angle θ, an image having a size (f×θ) obtained by multiplying a focal length f by the angle θ is formed. The optical scanning apparatus 2 further includes a reflecting (deflecting) mirror 118 and an optical box 119.

The laser beam flux L emitted from the semiconductor laser 112 shown in FIG. 2 is converged by the anamorphic collimator lens 113 in the following manner. In a main scan cross-section (in an axial direction of the photosensitive drum 103), the laser beam flux L is collimated (parallel) light beam or weakly converging light (beam). Further, in a sub-scan cross-section (in a circumferential direction of the photosensitive drum 103), the laser beam flux L is converging light (beam).

Thereafter, the laser beam flux L passes through the aperture stop 114 and a beam flux width thereof is limited, so that an image is formed as a line image on a reflecting surface of the rotatable polygonal mirror 115. This line image is formed as a line image such that a main scan direction (axial direction of the photosensitive drum 103) is a longitudinal direction.

The laser beam flux L formed as the image on the reflecting surface of the rotatable polygonal mirror 115 is deflected by rotating the rotatable polygonal mirror 115 so as to scan the photosensitive drum surface. The laser beam flux L is reflected by the reflecting surface of the rotatable polygonal mirror 115 and enters a BD (beam detection) sensor 120. At this time, a signal is detected by the BD sensor 120, so that this timing is synchronization detecting timing of a writing position with respect to the main scan direction.

Then, the laser beam flux L enters the fθ lens 117. The fθ lens 117 concentrates the laser beam flux L so that a spot is formed on the surface of the photosensitive drum 103 and is designed so that a scanning speed of the spot is maintained at a uniform (constant) speed. In order to obtain such a characteristic of the fθ lens 117, the fθ lens 117 is formed with an aspherical lens. The laser beam flux L passed through the fθ lens 117 is deflected by the reflecting mirror 118, so that an image is formed on the photosensitive drum 103 formed with a photosensitive member.

The fθ lens 117 and the reflecting mirror 118 which are shown in FIG. 2 are constituted as optical elements for forming the image on the surface of the photosensitive drum (photosensitive member) 103 and for scanning the surface of the photosensitive drum 103 with the laser beam flux L deflected by the light deflector 116. The optical box 119 accommodates at least the light deflector 116, the fθ lens 117 and the reflecting mirror 118 (which are optical elements). As shown in FIG. 1, the reflecting mirror 118 reflects the laser beam flux L deflected by the light deflector 116 towards a bottom plate 119*b* of the optical box 119.

The surface of the photosensitive drum 103 is deflection-scanned with the laser beam flux L by rotation of the rotatable polygonal mirror 115, so that main scanning with the laser beam flux L is carried out on the surface of the photosensitive drum 103. Further, sub-scanning is carried out by rotationally driving the photosensitive drum 103 in the circumferential direction. Thus, on the surface of the photosensitive drum 103, the electrostatic latent image depending on the image information is formed.

<Structure of Peripheral Portion of Optical Scanning Apparatus>

Figure 3:
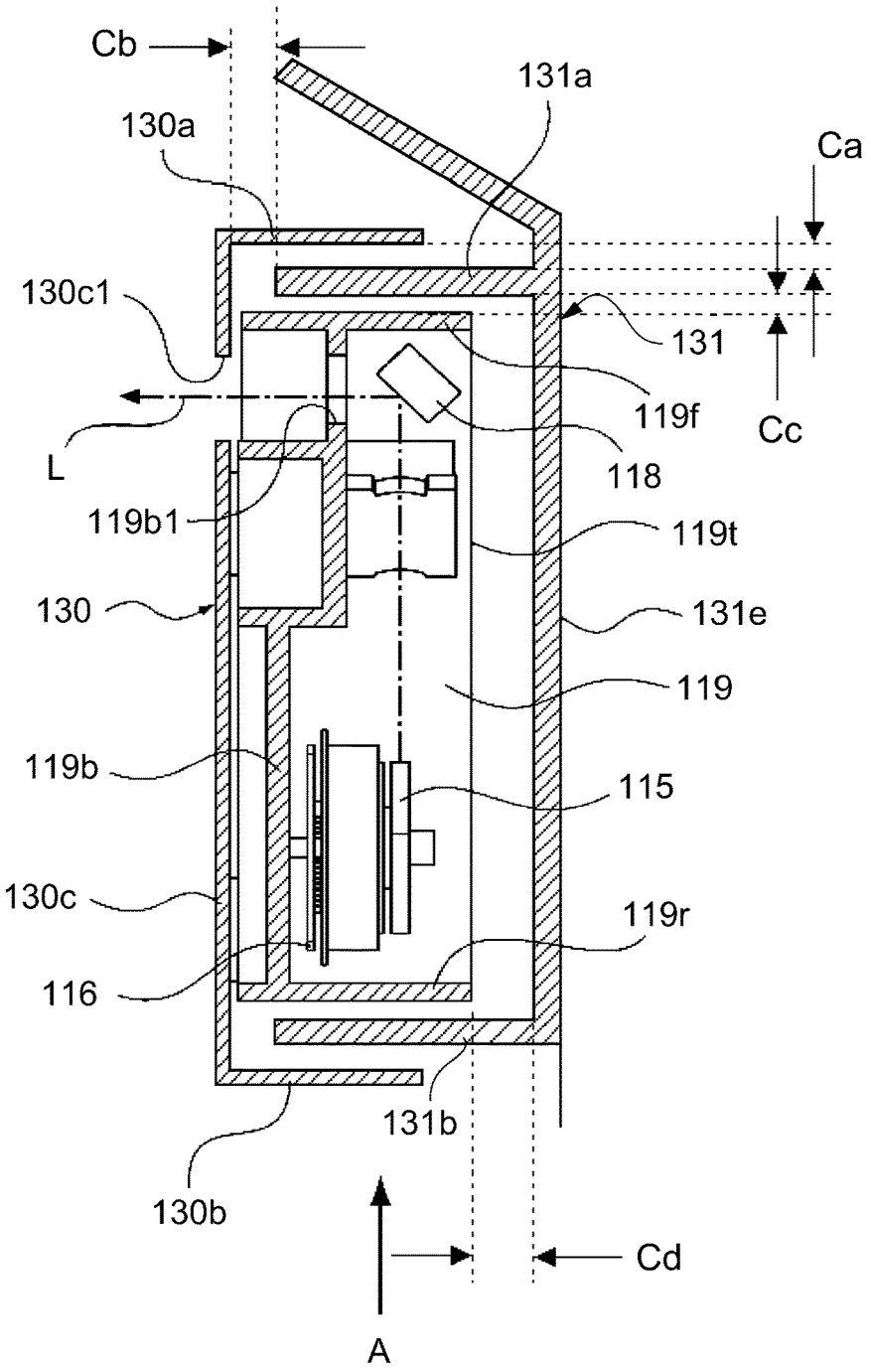
FIG. 3 is a partially enlarged view, of FIG. 1, showing a structure of a peripheral portion of the optical scanning apparatus of the image forming apparatus in Embodiment 1.
Figure 4:
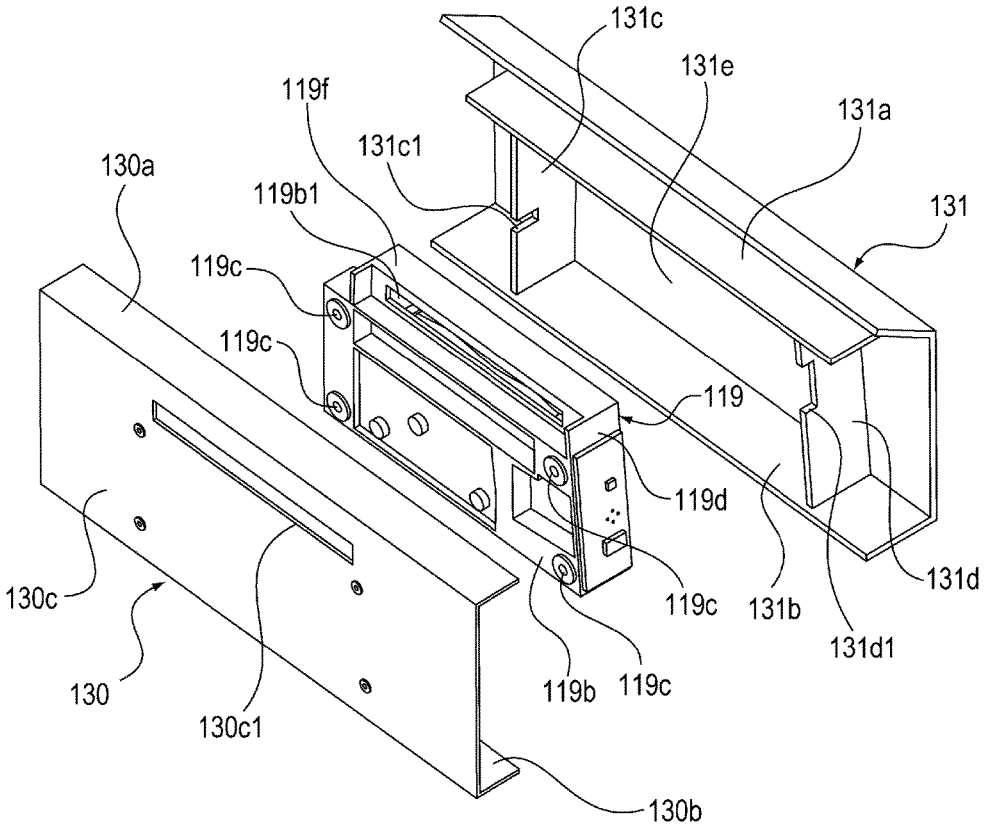
FIG. 4 is an exploded perspective view, of FIG. 3, showing a structure of a peripheral portion of the optical scanning apparatus of the image forming apparatus in Embodiment 1.

A structure of a peripheral portion of the optical scanning apparatus 2 will be described with reference to FIGS. 3 and 4. FIG. 3 is a partially enlarged view, of FIG. 1, showing the structure of the peripheral portion of the optical scanning apparatus 2 of the image forming apparatus 1 according to the present invention. FIG. 4 is an exploded perspective view, of FIG. 3, showing the structure of the peripheral portion of the optical scanning apparatus of the image forming apparatus 1 according to the present invention.

<Stay>

Referring to FIGS. 3 and 4, a stay 130 fixes the optical scanning apparatus 2. The stay 130 is formed with a metal plate or a resin mold and is formed in a U-shape in cross-section. The stay 130 performs a function as a structure for fixing the optical scanning apparatus 3 to an unshown main assembly frame side plate of the image forming apparatus 1. To a fixing portion 130*c* of the stay 130, bearing surfaces 119*c* provided on the bottom plate 119*b* of the optical box 119 are positioned and contacted, and are fixed with an unshown fixing member.

As a result, the optical box 119 is disposed so that an opening 119*t* faces an outside (right-hand side of FIG. 1) as seen from a central portion of the main assembly of the image forming apparatus 1 shown in FIG. 1. Further, the stay 130 is provided with cover ribs (first cover ribs) 130*a* and 130*b* substantially perpendicular to the fixing portion 130*c*. As shown in FIG. 3, the cover ribs 130*a* and 130*b* overlap with side walls 119*f* and 119*r* of the optical box 119 and are provided so as to cover the side walls 119*f* and 119*r* in a non-contact manner. The optical box 119 is disposed so as to be sandwiched between the cover ribs 130*a* and 130*b* provided on the stay 130.

<Cover Member>

An entirety of the opening 119*t* and the optical box 119 is, as shown in FIG. 1, covered with a front cover 131. The front cover 131 is in non-contact with the optical box 119, slight clearances Cc and Cd are provided between the optical box 119 and the front cover 131. The front cover 131 is fixed to an unshown main assembly frame of the image forming apparatus 1 at a portion other than the portion where the optical box 119 is disposed. In this embodiment, the clearance Cc between the front cover 131 and the optical box 119 in the image forming apparatus 1 is 1 mm. The clearances Cc and Cd between the front cover 131 and the optical box 119 and clearances Ca and Cd between the stay 130 and the front cover 131 may preferably be set in a range of 0.5 mm to 5 mm.

The front cover 131 is formed in a substantially U-shape in cross-section, and in an inside of the front cover 131, cover ribs (second cover ribs) 131*a* and 131*b* are provided. As shown in FIG. 3, the cover ribs 131*a* and 131*b* of the front cover 131 are provided substantially in parallel with the cover ribs 130*a* and 130*b* of the stay 130. As a result, as shown in FIG. 3, the cover rib 131*a* is disposed so as to enter between the side wall 119*f* of the optical box 119 and the cover rib 130*a* of the stay 130. Similarly, in an opposite side, the cover rib 131*b* is disposed so as to enter between the side wall 119*r* of the optical box 119 and the cover rib 130*b* of the stay 130. As seen in an arrow A direction, of FIG. 3, which is a direction parallel to a plane of the opening 119*t* of the optical box 119, the cover rib 130*a* of the stay 130, the cover rib 131*a* of the front cover 131 and the side wall 119*f* of the optical box 119 overlap with each other.

Further, similarly, in the opposite side, the cover rib 130*b* of the stay 130, the cover rib 131*b* of the front cover 131 and the side wall 190*r* of the optical box 119 overlap with each other.

As a result, although the opening 119*t* of the optical box 119 is not completely closed (covered), a dust entrance path (route) to the inside of the optical scanning apparatus 2 is formed in a labyrinth structure, so that it is possible to suppress entrance of the dust (dirt).

As shown in FIG. 4, the front cover 131 is provided, in addition to the cover ribs 131*a* and 131*b*, with cover ribs (second cover ribs) 131*c* and 131*d* disposed substantially perpendicular to the cover ribs 131*a* and 131*b*. The cover ribs 131*c* and 131*d* are provided with cut-away portions 131*c*1 and 131*d*1 for permitting passing of bundle wires such as an electric cable or the like connected with the light deflector 116 and an electric cable or the like connected with the semiconductor laser 112.

By providing the cover ribs 131*c* and 131*d* to the front cover 131, also with respect to the main scan direction (axial direction of the photosensitive drum 103) of the optical scanning apparatus 2, the dust entrance path to the inside of the optical scanning apparatus 2 can be formed in a labyrinth structure.

Thus, the front cover (cover member) 131 includes the cover ribs (second cover ribs) 131*a* to 131*d* for covering the side walls 119*d*, 119*e*, 119*f* and 119*r* of the optical box 119 in a non-contact manner. Further, as shown in FIG. 3, the side walls 119*f* and 119*r* of the optical box 119, the cover ribs (first cover ribs) 130*a* and 130*b* and the cover ribs (second cover ribs) 131*a* and 131*b* at least partly overlap with each other. That is, the side walls, the first cover ribs and the second cover ribs are disposed so that at least all of a part of the side walls, a part of the first cover ribs and a part of the second cover ribs overlap with each other.

As shown in FIG. 4, the front cover (cover member) 131 covers five surfaces (the opening 119*t* and the side walls 119*d*, 119*e*, 119*f* and 119*r*) of six surfaces of the optical box 119 by a surface plate 131*a* and the cover ribs (second cover ribs) 131*a* to 131*d*.

Thus, an entirety of all of the surfaces of the optical box 119 of the optical scanning apparatus 2 in the opening 119*t* side is covered with the cover ribs 131*a* to 131*d* of the front cover 131. As a result, entrance of the dust or the like into the optical box 119 can be prevented. Further, also the stay 130 is similarly provided with the cover ribs 130*a* and 130*b* extending along the main scan direction (axial direction of the photosensitive drum 103) of the optical scanning apparatus 2, so that the peripheral portion of the optical scanning apparatus 2 can be covered and thus the entrance of the dust or the like into the optical box 119 can be prevented.

In this embodiment, there is no cap of covering the opening 119*t* in direct contact with the optical box 119. For this reason, a cost of the optical scanning apparatus 2 can be suppressed. Further, the surface plate 131*e* and the cover ribs 131*a* and 131*d* of the front cover 131 and the cover ribs 130*a* and 130*b* of the stay 130 which are shown in FIG. 4 cover the peripheral portion of the optical box 119 by the labyrinth structure with predetermined clearances. As a result, even in the case where the dust or the like enters the inside of the main assembly of the image forming apparatus 1, a path until the dust or the like enters the inside of the optical box 119 is long and is complicated like a labyrinth. As a result, the entrance of the dust or the like into the optical box 119 is prevented, so that deposition of the dust or the like on the respective optical elements can be prevented.

Further, the bottom plate 119*b* of the optical box 119 is fixed to the fixing portion 130*c* of the stay 130. On the other hand, the side walls 119*f*, 119*r*, 119*d* and 119*e* are spaced from the cover ribs 130*a* and 130*b* of the stay 130 and the cover ribs 131*a* and 131*d* and the surface plate 131*e* of the front cover 131 with the predetermined clearances. As a result, vibration generating due to an unbalance of the light deflector 116 is not conducted (transmitted) to the front cover 131 through the optical box 119. For this reason, noise can be suppressed.

Thus, according to this embodiment, there is no cap directly covering the optical box 119, so that the noise due to the vibration of the light deflector 116 can be suppressed while maintaining a dust-proof performance in the inside of the optical box 119 with a small number of parts (components).

As shown in FIG. 1, the reflecting mirror 118 reflects the laser beam flux L, deflected by the light deflector 116, toward the bottom plate 119*b* of the optical box 119. As shown in FIG. 3, the laser beam flux L reflected by the reflecting mirror 118 passes through a through hole 119*b*1 provided in the bottom plate 119*b* of the optical box 119 and a through hole 131*c*1 provided in the fixing portion 130*c* of the stay 130, so that the surface of the photosensitive drum 103 is irradiated with the laser beam flux L. As a result, the laser beam flux L can be introduced toward the bottom plate 119*b* side of the optical box 119 while avoiding the labyrinth structure covering the peripheral portion of the optical box 119.

Embodiment 2

In Embodiment 1 described above, a method for simply maintaining a dust-proof property with an inexpensive constitution was described. In Embodiment 2, a constitution for further enhancing the dust-proof property by adding a member (part) to the constitution of Embodiment 1 will be described. Incidentally, portions (members) similar to those in Embodiment 1 described above are represented by the same reference numerals or symbols and will be omitted from description.

Figure 5:
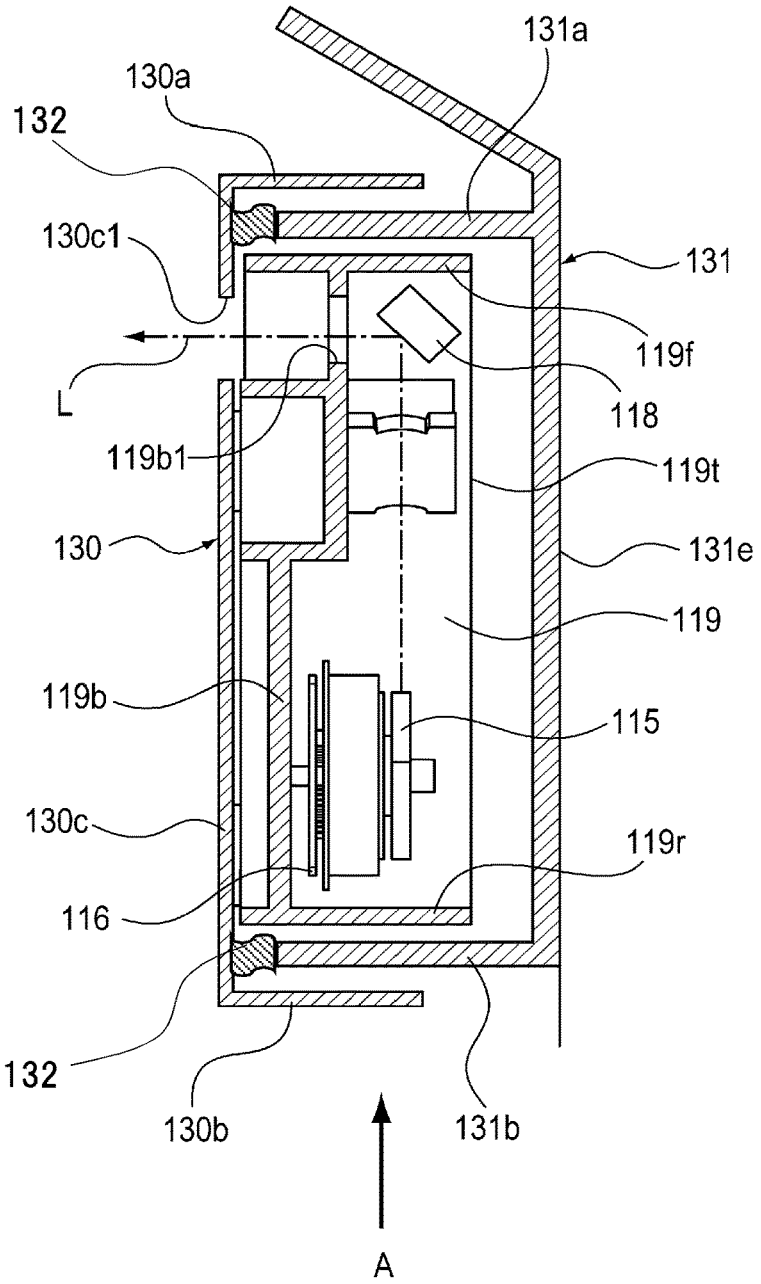
FIG. 5 is a partially enlarged view showing a structure of a peripheral portion of an optical scanning apparatus of an image forming apparatus according to Embodiment 2 of the present invention.

In Embodiment 1, the front cover 131 is constituted in non-contact with each of the stay 130 and the optical box 119 and is disposed so as to provide the labyrinth structure, but hermetic sealing is not ensured. In order to ensure the hermetic sealing, there is a need to ensure contact between the front cover 131 and the stay 130 and contact between the front cover 131 and the optical box 119, but when these members are contacted to each other directly, as described above, there is a liability that the vibration of the light deflector is conducted (transmitted) to the cover member to cause the noise. Therefore, in order to ensure the hermetic sealing while completely preventing the transmission of the vibration, for example, a sponge member 132 may preferably be clogged between the stay 130 and free ends of the cover ribs 131*a* to 131*d* of the front cover 131 as shown in FIG. 5. At this time, it is desirable that the sponge member 132 has a single-cell structure since the dust or the like does not readily pass through the sponge member 132. Further, in order to ensure less transmission of the vibration, the sponge member 132 may also be replaced with an elastic member such as a rubber member. Or, the sponge member 132 may also be replaced with a tape member, so that the clearances are closed. Further, a similar effect can be obtained also by clogging, with the above-described materials, the surface plate 131*e* of the front cover 131 are free ends of the side walls 119*f*, 119*r*, 119*d* and 119*e* of the optical box 119. By clogging the clearances with the sponge member 132, the elastic member or the like, a hermetical sealing property of the optical box 119 can be further enhanced without directly transmitting the vibration to the cover member.

Embodiment 3

In Embodiment 1 described above, the method for maintaining the dust-proof property with a constitution in which the front cover 131 is in non-contact with the stay 130 and the optical box 119 was described. In Embodiment 3, a constitution for further enhancing the hermetic sealing property by being partial and positively contacted to an associated member and for suppressing noise due to transmission of the vibration of the light deflector will be described. In the image forming apparatus and the optical scanning apparatus in Embodiment 3, portions (members) similar to those in Embodiment 1 described above are represented by the same reference numerals or symbols and will be omitted from description.

Figure 6:
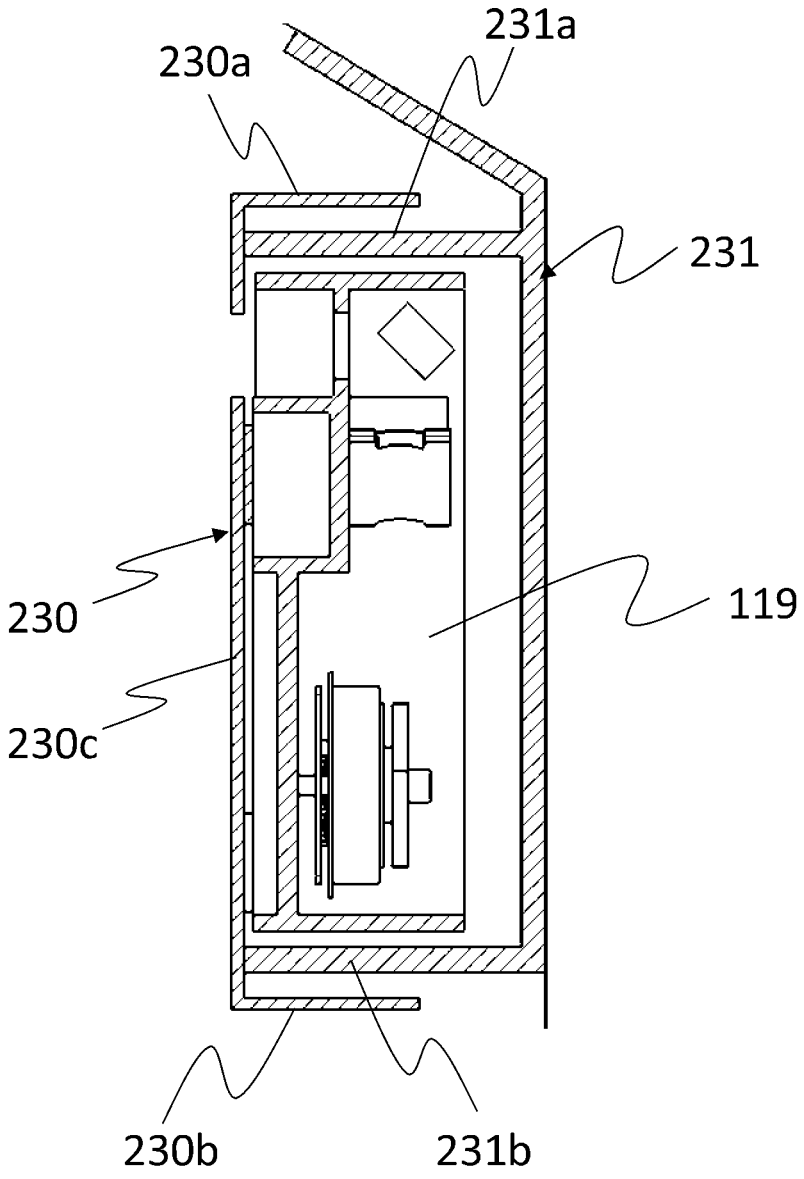
FIG. 6 is a partially enlarged view showing a structure of a peripheral portion of an optical scanning apparatus of an image forming apparatus according to Embodiment 3 of the present invention.
Figure 7:
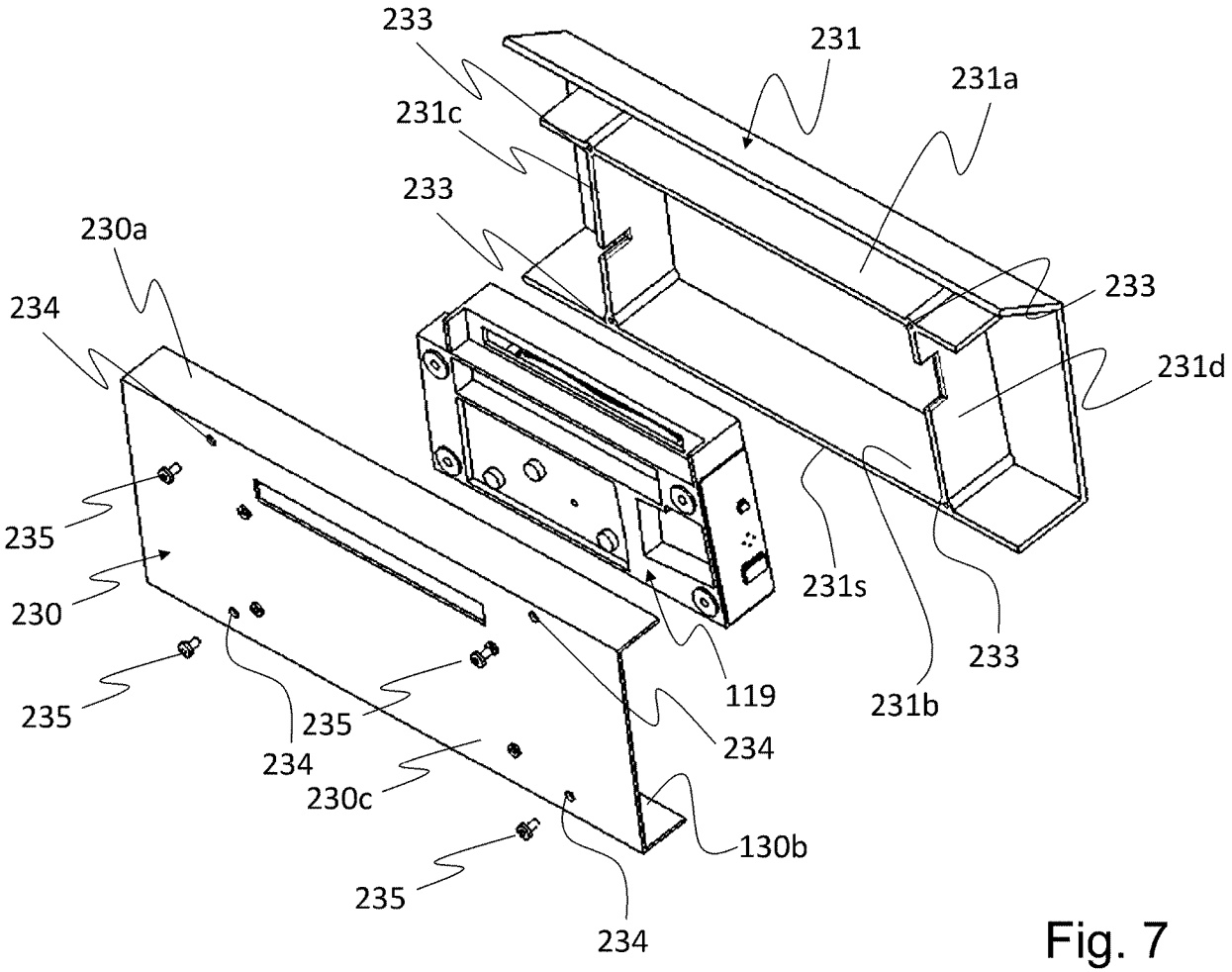
FIG. 7 is an exploded perspective view showing a structure of the peripheral portion of the optical scanning apparatus of the image forming apparatus in Embodiment 3.

A structure in this embodiment will be described with reference to FIGS. 6 and 7. FIG. 6 is a partially enlarged sectional view showing a structure of a peripheral portion of an optical scanning apparatus 2 of an image forming apparatus 200 according to this embodiment. FIG. 7 is a partial perspective view, of FIG. 6, showing the structure of the peripheral portion of the optical scanning apparatus 2 of the image forming apparatus 200 according to this embodiment.

A difference from Embodiment 1 is that a fixing portion 230*c* of a stay 230 and a cover ribs 231*a*, 231*b*, 231*c* and 231*d* of a front cover 231 are in contact with each other. The cover ribs 231*a* to 231*d* of the front cover 231 hermetically contact the fixing portion 230*c*, so that at a peripheral portion of the optical scanning apparatus 2, a substantially hermetically closed (sealed) space except for a through hole 230*c*1 which is an emitting (outgoing) opening of the laser beam flux L. The front cover 231 does not directly contacts the optical box 119, so that the vibration of the light deflector 116 is not readily transmitted to the front cover 231 tough the optical box 119 and thus the noise can be suppressed.

Further, as shown in FIG. 7, free end portions of the cover ribs 231*a* and 231*d* of the front cover 231 are flush with each other to form the same surface 231*s*, and the surface 231*s* contacts the fixing portion 230*c*, so that a degree of hermetic sealing is improved. In addition, in the neighborhood of four corners of the cover ribs 231*a* and 231*d*, screw fixing holes 233 are provided. On the other hand, the stay 230 is provided with screw holes 234 at portions corresponding to the screw fixing holes 233, so that the stay 230 and the front cover 231 are directly fixed from the stay side with screws 235. That is, a constitution in which the stay 230 holds (supports) the front cover 231 is employed.

Further, at this time, by employing the constitution in which the stay 230 holes the front cover 231, a weight of constituent parts of the stay 230 and screw fixing points can be changed in specific ranges, and therefore, a natural frequency can also be deviated from a rotational frequency of the light deflector 116 and frequencies of other driving parts, so that the vibration of the stay 230 can also be suppressed.

Embodiment 4

Figure 8:
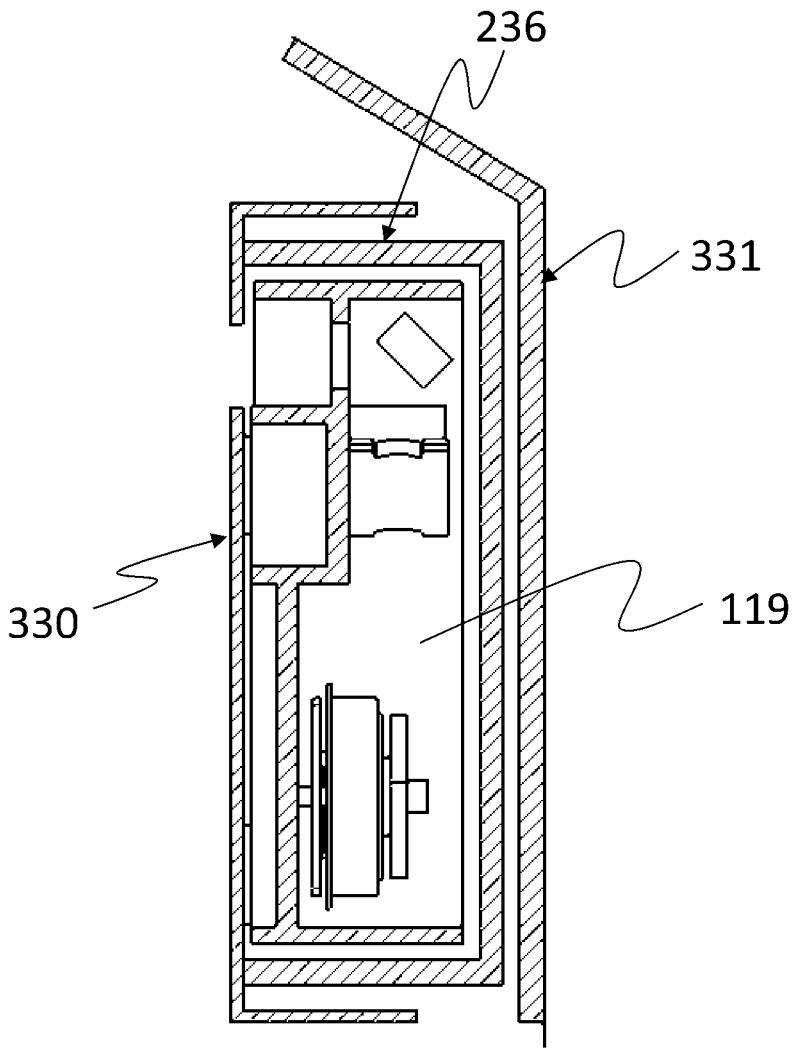
FIG. 8 is a partially enlarged view showing a structure of a peripheral portion of an optical scanning apparatus of an image forming apparatus according to Embodiment 4 of the present invention.

A method for suppressing the noise due to the vibration of the light deflector, while maintaining the dust-proof performance in the inside of the optical box, in a manner different from those of Embodiments 1 to 3 described above will be described with reference to FIG. 8.

Between a front cover 331 and the optical box 119, a box-shaped cover member 236 which is a separate part (member) from the front cover 331 is provided. The cover member 236 is directly fixed to a stay 330 without contacting the optical box 119 and substantially hermetically closes 8 seals) a peripheral portion of the optical box 119.

Further, a sound-absorbing (inside-reducing) member is applied onto an inner surface of the cover member 236 or the cover member 236 is formed of a material having a large transmission loss of the sound, so that it is possible to realize sound insulation of wind noise of the rotatable polygonal mirror 115.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2016-206462 filed on Oct. 21, 2016 and 2017-150540 filed on Aug. 3, 2017, which are hereby incorporated by reference herein in their entirety.

What is claimed is:

1. An image forming apparatus comprising:

a photosensitive member;

an image forming process portion actable on said photosensitive member;

a scanner unit configured to emit light to said photosensitive member depending on image information, said scanner unit including an optical element and an optical box accommodating said optical element; and an outer cover consisting of a part of an external frame of said image forming apparatus, wherein said optical box has an open, and wherein the open of said optical box faces said outer cover and is covered with said outer cover.

2. An image forming apparatus according to claim 1, further comprising a stay constituting a frame of said image forming apparatus, wherein said optical box is mounted to said stay at a surface thereof opposite from a surface where the open is formed.

3. An image forming apparatus according to claim 1, wherein a clearance between an edge, of said optical box, defining the open and said outer cover is set in a range of 0.5 mm or more and 3 mm or less.

4. An image forming apparatus according to claim 2, wherein said stay is in non-contact with a side wall of said optical box and includes a first cover rib covering the side wall, wherein said outer cover is in non-contact with the side wall of said optical box and includes a second cover rib covering the side wall, wherein the side wall, said first cover rib and said second cover rib are provided in non-contact with each other, and wherein a part of the side wall, a part of said first cover rib and a part of said second cover rib overlap with each other.

5. An image forming apparatus according to claim 4, wherein between said second cover rib and at least one of said optical box and said stay, an elastic member is provided.

6. An image forming apparatus comprising:

a photosensitive member;

an image forming process portion actable on said photosensitive member;

a scanner unit configured to emit light to said photosensitive member depending on image information, said scanner unit including an optical element and an optical box having an open and accommodating said optical element; and an outer cover consisting of a part of an external frame of said image forming apparatus, wherein the open of said optical box is covered with said outer cover.

7. An image forming apparatus according to claim 6, further comprising a stay constituting a frame of said image forming apparatus, wherein said stay is in non-contact with a side wall of said optical box and includes a first cover rib covering the side wall, wherein said outer cover is in non-contact with the side wall of said optical box and includes a second cover rib covering the side wall, wherein the side wall, said first cover rib and said second cover rib are provided in non-contact with each other, and wherein a part of the side wall, a part of said first cover rib and a part of said second cover rib overlap with each other.

8. An image forming apparatus according to claim 7, wherein said second cover rib contacts said stay.

9. An image forming apparatus according to claim 7, wherein said outer cover is held by said stay.

* * * * *